US005166735A

United States Patent [19]

Malachowski

[11] Patent Number: 5,166,735

[45] Date of Patent: Nov. 24, 1992

[54] SHEET BUCKLE SENSING

[75] Inventor: Michael A. Malachowski, Webster, N.Y.

[73] Assignee: Xerox Corporation, Stamford, Conn.

[21] Appl. No.: 894,671

[22] Filed: Jun. 5, 1992

[51] Int. Cl.[5] ..... G03G 15/20

[52] U.S. Cl. ..... 355/282; 271/202; 271/270; 355/295; 355/309

[58] Field of Search ..... 355/282, 285, 289, 290, 355/295, 308, 309, 321, 311, 208, 73, 312; 219/216, 469; 432/60; 271/176, 199, 202, 203, 270

[56] References Cited

U.S. PATENT DOCUMENTS

| | | | |
|---|---|---|---|
| 3,508,824 | 4/1970 | Leinbach et al. | 355/315 |
| 3,601,392 | 8/1971 | Spear, Jr. et al. | 271/53 |
| 3,774,907 | 11/1973 | Borostyan | 355/312 X |
| 3,882,744 | 5/1975 | McCarroll | 83/262 |
| 4,017,065 | 4/1977 | Poehlein et al. | 271/80 |
| 4,017,067 | 4/1977 | Soures et al. | 271/80 |
| 4,286,863 | 9/1981 | Cornwall et al. | 355/295 |
| 4,632,381 | 12/1986 | Cuir et al. | 271/270 |
| 4,641,272 | 2/1987 | Sasaki et al. | 355/309 X |
| 4,928,141 | 5/1990 | Poehlin et al. | 355/208 |
| 4,941,021 | 7/1990 | Uchida et al. | 355/285 |
| 5,046,146 | 9/1991 | Bartman et al. | 219/216 |
| 5,050,859 | 9/1991 | Paxon | 271/270 |
| 5,118,589 | 6/1992 | Aslam et al. | 355/290 X |

*Primary Examiner*—Joan H. Pendegrass
*Assistant Examiner*—Christopher Horgan
*Attorney, Agent, or Firm*—Oliff & Berridge

[57] ABSTRACT

A sheet transport system incorporating a control for matching drive speeds imparted to a sheet extending between adjacent workstations is disclosed. The copy sheet is engaged by a receiving surface disposed between the workstations and is adhered to the receiving surface by vacuum. The copy sheet follows a path offset from a linear path extending between the workstations. Fuser rolls are driven at a slightly higher speed to tension the copy sheet and lift it from the transport surface. The lifting is detected by a sensor for sensing the vacuum in a plenum communicated with the receiving surface. The drive speed of the fuser rolls is controlled in accordance with the signal from the sensor.

27 Claims, 2 Drawing Sheets

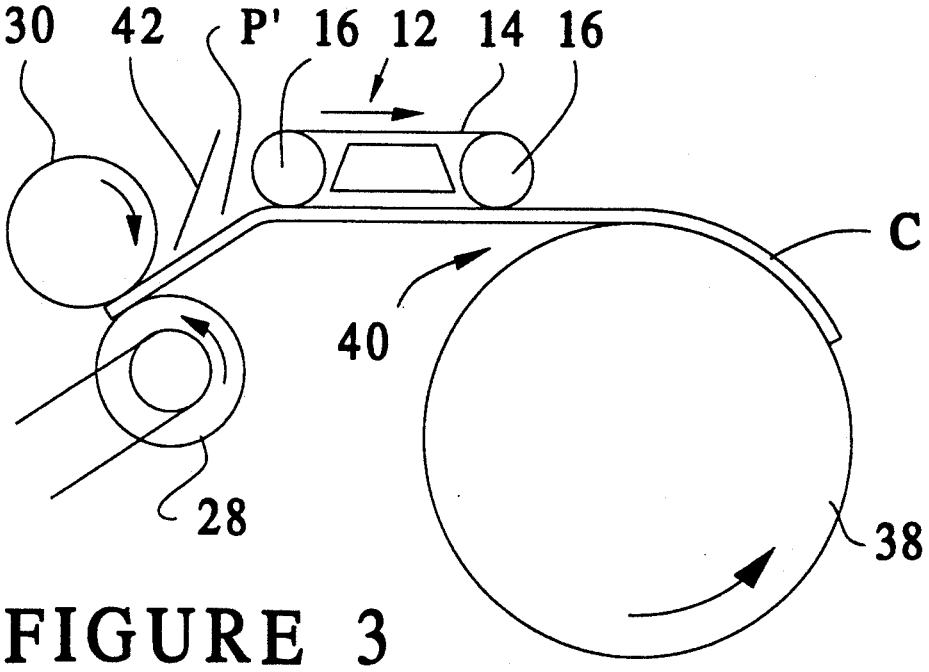
FIGURE 3
FIGURE 4A
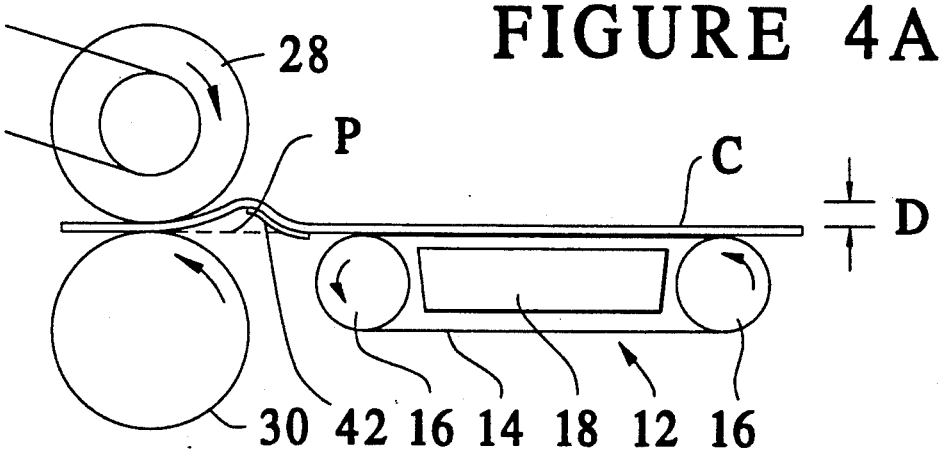
FIGURE 4B
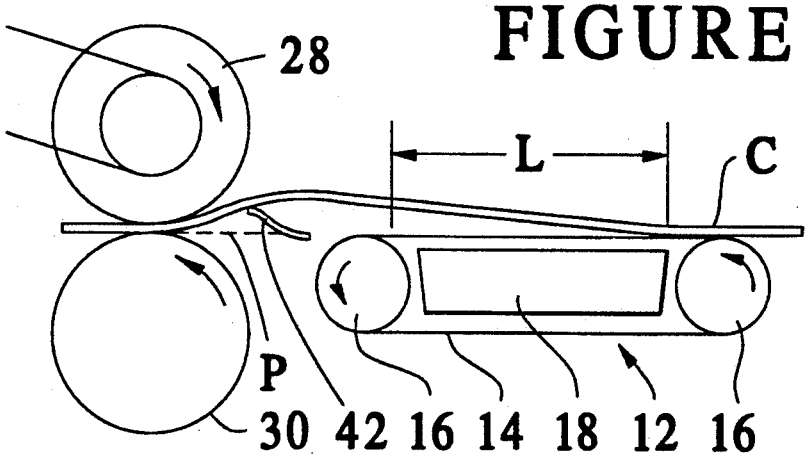

SHEET BUCKLE SENSING

BACKGROUND OF THE INVENTION

1. Field of the Invention

This invention relates to sheet handling systems. It has particular applicability to sheet handling systems for use in fused image printers and copiers.

2. Description of Related Developments

In a transfer electrostatographic process such as conventional transfer xerography, in which an image pattern of dry particulate unfused toner material is transferred to a final image support surface, e.g., a copy sheet from an initial image bearing surface, e.g., a charged photoreceptor surface developed with toner, the transferred toner is typically only loosely applied to the final image support surface after transfer, and is easily disturbed by the process of stripping the final image support surface away from the initial support surface and by the process of transporting the final image support surface to the toner fusing station. The final image support surface preferably passes through a fusing station as soon as possible after transfer to fuse the toner image permanently onto the final image support surface, thereby preventing smearing or disturbance of the toner image by mechanical agitation or electrical fields. For this reason, and also for the reasons of simplifying and shortening the paper path of the copier, it is desirable to maintain the fusing station as close as possible to the transfer station. A particularly desirable fusing station is a roll-type fuser, wherein the copy sheet is passed through a pressure nip between two rollers, at least one of which is heated and at least one of which is resilient.

However, when such a fuser roll nip for the final image support surface is located close enough to the transfer station so that a lead portion of the final image support surface can be in the fuser roll nip simultaneously with the rear or trailing portion of the same final image support surface still being in contact with the photoreceptor, smears or skips in the unfused toner image, which is being transferred to the trailing portion of the final image support surface, can occur. This condition is caused by relative movement or slippage between the initial support surface and the final image support surface in those areas where they are still in contact, i.e., those areas of the final image support surface which has not yet been stripped away from the initial support surface. A source of such slippage is a speed mismatch between the nip speed of the fuser rolls (the speed at which the fuser is pulling the lead edge of the paper through the fuser) relative to the surface speed of the initial support surface. If the fuser nip roll is slower, the final image support can slip backwards relative to the initial image support surface. If the fuser roll is faster, the final image support material can be pulled forward relative to the image on the initial support surface. In either case, this can cause the aforementioned smears or skips in the toner image to be transferred to the trailing area of the final image support or to cause image elongation.

An exactly equal velocity drive connection between the initial support surface and the fuser rolls is difficult to maintain. Also, there is a further complication that the actual sheet driving velocity of the fuser nip roll can change with changes in an effective diameter of the driving roll in the nip. This can occur from replacement of the rollers or changes in the resilient deformation of the rollers due to changes in applied nip pressure, material aging, temperature effects, etc. Thus, equal speed is difficult to maintain between a fuser nip roll and the photoreceptor surface in commercial printing apparatus and can require increased maintenance and the need for speed adjustment mechanisms.

In order to overcome these problems, three basic design approaches have been taken. The first is to allow enough paper path distance between transfer and fusing to accommodate most paper sizes with minimum disturbance to unfused toner particles. This solution has the effect of increasing the length of the paper path, thereby requiring the copier to occupy a large floor area. This is disadvantageous, especially to customers having limited space availability or having high floor space costs.

A second approach is to use complex paper paths with special transports. This solution is undesirable because it adds cost to the equipment and introduces potential sources of maintenance requirements and unreliablity.

A third approach is to use buckle chambers between the transfer station and the fuser so that speed mismatches between the transfer station and the fuser rolls can be accommodated by the portion of the image support surface that is in the buckle. U.S. Pat. No. 4,017,065 shows one such buckle arrangement. In the designs disclosed in this patent, the image surface is formed in a buckle by being drawn, by vacuum, against a guide surface. The fuser roll nip is intentionally driven at a different speed than the transfer speed to form a buckle. The buckle is controlled by cyclic reductions in the vacuum applied to the guide surface. Another approach is shown in U.S. Pat. No. 4,941,021, wherein a buckle is formed by controlling the speed of the fuser rolls so that the image support surface travels more slowly through the fuser rolls than through the transfer zone. This system requires sensing of the buckle to maintain the size of the buckle within predetermined limits. Such sensing systems add manufacturing cost and require maintenance, as dust and dirt within the equipment can interfere with sensing, particularly when optical detectors are used.

SUMMARY OF THE INVENTION

It is an object of the invention to provide a sheet transport system with matched speeds between adjacent workstations.

It is a further object of the invention to provide a sheet transfer system wherein the path length is minimized.

It is an additional object of the invention to provide a sheet handling system having a reduced cost and increased reliability.

It is a further object of the invention to improve the image quality in fused toner printing systems.

These and other objects of the inventions are achieved by the use of a sheet handling system with a transport section offset from a linear path between adjacent workstations. Image support sheets are drawn against a sheet transport surface by vacuum. A pressure sensor is arranged to sense the vacuum within a plenum associated with the transport surface to detect separation of the sheet from the transport surface resulting from tension in the sheet. The separation is indicative of the speed differential between downstream and upstream workstations. The signal from the pressure sensor is used to reduce or eliminate this speed differential.

BRIEF DESCRIPTION OF THE DRAWING

FIG. 3 illustrates an embodiment employing a top transport arrangement;

FIG. 4A illustrates another embodiment of the invention utilizing a deflector and showing the position of a sheet just as the lead edge reaches the fuser station; and FIG. 4B illustrates the embodiment in FIG. 4A just after the leading edge of the copy sheet has been engaged in the nip of the fuser rolls.

DESCRIPTION OF PREFERRED EMBODIMENTS

Figure 1:
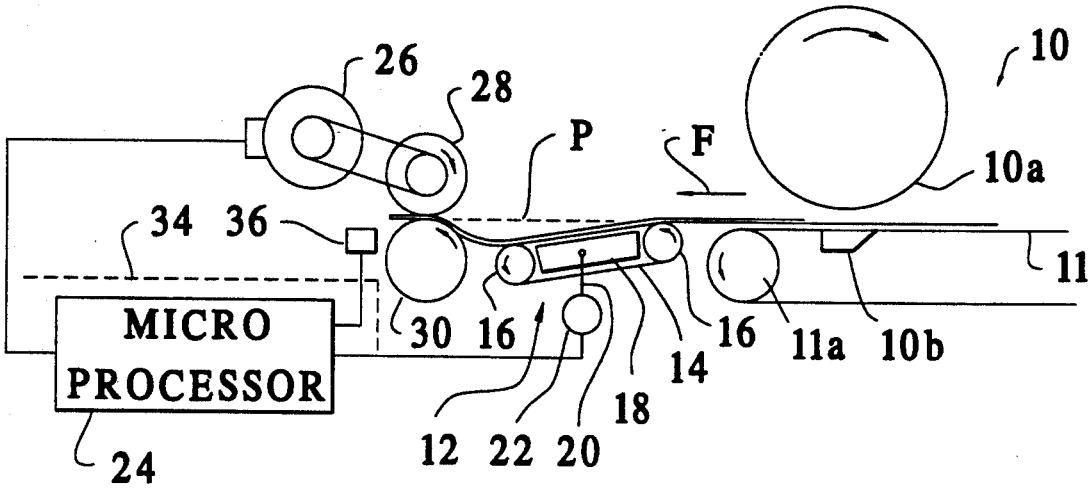
FIG. 1 schematically illustrates a printing system embodying the invention.

FIG. 1 schematically illustrates a portion of printing equipment, such as a xerographic copier. In this arrangement, fused toner images are formed on a image support, such as a copy sheet C. In this process, an unfused toner image is first formed on the upper surface of the sheet C at the transfer station 10. As is conventional, a photoreceptor in the form of a drum 10*a* or a belt, is arranged to transfer unfused toner particles from the imaged photoreceptor to the upper surface of copy sheet C by electrostatic attraction created by, for example, a corotron 10*b*. The particular manner in which the toner image is formed on the photoreceptor and transferred to the copy sheet C is not a part of this invention and further description is not necessary, other than to indicate that such systems are widely known.

The copy sheet C is driven in the direction of arrow 11 by the moving surface of the photoreceptor drum 10*a* or by a supporting belt 11, that is driven by a motor driven roll 11*a* or other suitable drive system (not shown) at a preset speed.

The copy sheet C travels in the direction of arrow F to transport station 12 downstream from the transfer station 10. The transport station 12 has a sheet receiving surface, such a foraminous belt 14 trained over rollers 16, at least one of which is driven by a motor or driving system (not shown). The belt 14 is driven at a speed substantially equal to the speed of copy sheet C in transfer station 10. At least a portion of the belt 14 is offset from or spaced from a line P, that is linear path between the transfer station 10 and the nip of the fuser rolls 28, 30. A plenum 18 communicates with the upper surface of the belt 14 so that the copy sheet C is drawn against the belt 14. A fluid conduit 20 extends from the plenum 18 to a pressure sensor 22, such as a pressure switch or pressure transducer so that the vacuum within the plenum 18 can be sensed. Alternatively, the pressure switch or transducer can be located in plenum 18. The vacuum in the plenum 18 changes as a result of the amount of the surface area of copy sheet C adhered to the foraminous belt 14 by the vacuum. For example, if the copy sheet C covers the portion of the belt 14 overlying plenum 18, thereby sealing the openings in the belt 14, the vacuum is high. However, if the copy sheet C is drawn away from or separated from the belt 14, as will be explained later, the vacuum within plenum 18 is reduced.

The electrical signal from the transducer 22 is supplied to a microprocessor 24 that can comprise the main controller for the printer/copier or a dedicated microprocessor. The microprocessor 24 includes processing routines for controlling the speed of a stepper or servo motor 26 for driving one of the fuser rolls 28. The control function can be implemented by, for example, a look-up table, with empirically determined values, for decreasing the motor 26 speed in proportion to the amount of the vacuum drop sensed by sensor 22. Such control routines are within the programming skills of machine designers and no further detailed explanation is necessary.

Figure 2:
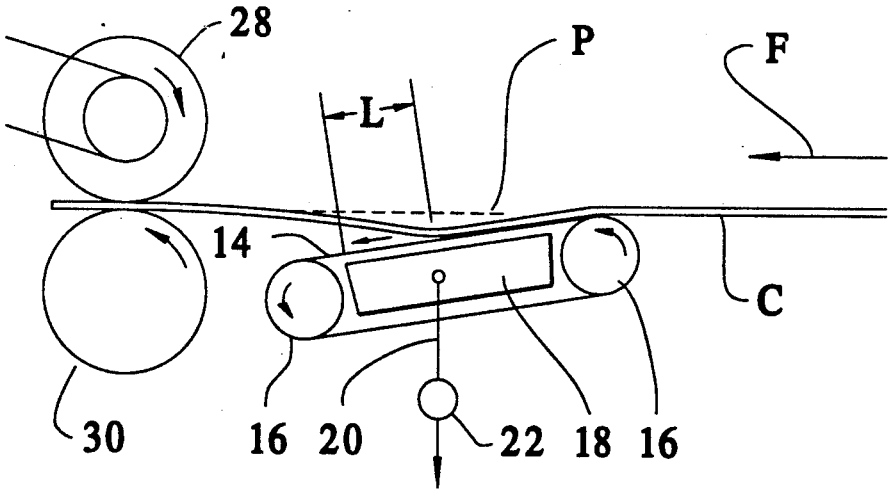
FIG. 2 illustrates separation of the copy sheet from the sheet receiving surface of the sheet transport.

The amount of surface area of the copy sheet C from the surface of the belt 14 is a function of the difference in speed imparted to the copy sheet C at the transfer station 10 and by the fuser rolls 28, 30. Prior to the arrival of the leading edge of each successive copy sheet C, the drive speed of the motor 26 is initialized at a value such that the fuser rolls 28, 30 impart a higher speed to the copy sheet C than that imparted at the transfer station 10 and by belt 14. The higher initial speed can be set as a result of the detection of the absence of a copy sheet in the fuser nip by a suitably positioned sensor 36. As a result of the higher initial speed, when the lead edge of the copy sheet C is first engaged in the nip of the rolls, the sheet is tensioned and separates from the belt 14 over a length L, as shown in FIG. 2. The exposure of belt 14 to ambient conditions results in a decrease in the vacuum level within plenum 18. A signal representative of the pressure differential sensed by the transducer 22 is supplied to the microprocessor to decrease the speed of motor 26 slightly, which results in a lessening of the tension imparted to the copy sheet C and a decrease in the length of exposed belt L. Ideally, the control speed of motor 26 is controlled so that substantially all of the upper surface of belt 14 is engaged by the copy sheet S, as shown in FIG. 1. The speed is constantly adjusted until the trailing edge of the copy sheet C clears the transfer zone. In this manner, the speed imparted to the copy sheet C by the fuser rolls 28, 30 is brought to a level to closely match the speed imparted to the copy sheet at the transfer station 10, thereby avoiding disturbance of toner transfer at the transfer station 10.

In a second embodiment, the transducer 22 can comprise a pressure switch having an on-off state in a range designed to maintain the copy sheet C against belt 14, as shown in FIG. 1. In this embodiment, the switch 22 is connected to motor 26 through a lead 34 to turn the motor 26 on and off. When the vacuum in plenum 18 increases to the "on" set point of the switch, the motor 26 is activated to drive fuser rolls 28, 30 and the copy sheet C is drawn away from belt 14. Conversely, when a high vacuum exists in plenum 8, indicating the length L is reduced, the switch 22 deactivates motor 26, allowing the copy sheet to be separated from a portion of the belt 14. The speed profile of the motor 26, which ramps up and ramps down as the motor is cycled on and off by pressure switch 22, imparts an average drive speed to rolls 28, 30, thereby maintaining the desired amount of buckle in the copy sheet C. This control arrangement has the advantage of eliminating the servo algorithms implemented by microprocessor control, as used in the previously described embodiment.

In another embodiment, illustrated in FIG. 3, the transport system 12 is located in an upper position immediately adjacent a transfer or photoreceptor drum 38 which conveys the copy sheet C. The copy sheet C may be adhered to the surface of the drum by known techniques, for example electrostatic tacking. Elements common with FIG. 1 are like numbered. The copy sheet C is separated from drum 38 by known means, for example, a separator 40, and is drawn against the foraminous belt 14. The copy sheet adheres to the belt 14 and is carried toward the exit end of the transport station 12. A deflector 42 is positioned downstream of the end of belt 14. The deflector 42 deflects the leading edge of copy sheet C away from the straight path $P_1$ toward the nip of fuser rolls 28, 30. As shown, the nip of rollers 28, 30 is offset downwardly from the path $P^1$.

This embodiment operates in substantially the same manner as the FIG. 1 embodiment. That is, the speed of the rollers 28, 30 is in initialized to impart a higher speed to the copy sheet C than the drum 38 and transport 12, thereby initially causing the copy sheet C to be tensioned and separated from the belt 14. The vacuum in plenum is sensed to control the speed of roller 28 so that, in a steady state condition, the copy sheet C follows a path substantially as shown in FIG. 3.

FIGS. 4A and 4B show another embodiment of the invention wherein the foraminous 14 of the transport 12 is arranged substantially parallel and coincident with the path P, which extends between the nip of the roller 28 to 30 and a downstream transfer station (not shown). Elements common with the FIG. 1 embodiment are like numbered. In this arrangement, a deflector 42' is arranged at the downstream end of the belt 14 to deflect the leading edge of the copy sheet C away from the path P by a slight distance D. As the leading edge of the copy sheet C advances toward the fuser rollers 28, 30, it is located distance D above the path P but is then urged downwardly by the roller 28 into the nip formed by rollers 28, 30. As in the previous embodiments, the rollers 28, 30 are initialized at a speed that imparts tension on a copy sheet C. As a result, as the leading edge of the copy sheet C is engaged in the nip of rollers 28, 30 the sheet is tensioned over the deflector 42' and a portion of the copy sheet C is lifted from the belt over a length L as shown in FIG. 4B. As the sheet C separates from the belt 14, the vacuum in plenum 18 is reduced and can be sensed to control the speed of rolls 28, 30 as in previous embodiments.

Although, in the foregoing description, the speed of fuser rolls 28, 30 is controlled, similar results can be achieved by controlling the copy drive speed at transfer station 10 (via belt 11 or drum 38) and transport station 12 (via belt 14) relative to the speed of the fuser rolls 28, 30.

As can be seen from the foregoing, a reliable and cost effective system is provided for controlling transport of that copy sheet. The system can be easily integrated into existing system architectures.

I claim:

1. A transport system for serially transporting sheets comprising:

a first zone;

first drive means at the first zone for driving the sheets;

a second zone located downstream of the first zone a distance less than the length of said sheets;

a second drive means at the second zone for driving the sheets;

a sheet receiving surface disposed between the first drive means and the second drive means for receiving a portion of a sheet extending between the first and second drive means;

separation determining means for determining separation of a sheet from the sheet receiving surface by tension resulting from a speed differential between the first drive means and the second drive means; and speed control means responsive to the separation determining means for controlling a speed differential between the first and the second drive means, to maintain the sheets toward the receiving surface.

2. A sheet transport system as in claim 1, wherein the receiving surface includes a vacuum means for drawing the sheets toward the receiving surface.

3. A sheet transport system as in claim 2, wherein the vacuum means includes a plenum and wherein the separation determining means includes means for sensing pressure within the plenum.

4. A sheet transport system as in claim 3, wherein the receiving surface comprises a movable belt.

5. A sheet transport system as in claim 1, wherein the second drive includes means for initializing the speed thereof to drive the sheets at a speed higher than the speed at which the first drive means drives the sheets.

6. A sheet transport system as in claim 1, wherein the speed control means controls the second drive means.

7. A sheet transport system as in claim 4, wherein a portion of the belt is offset from a linear path extending between the first drive means and the second drive means.

8. A sheet transport system as in claim 1, further comprising a deflector adjacent a downstream end of the sheet receiving surface for deflecting the copy sheet away from a linear path extending between the first drive means and the second drive means.

9. A copier for forming images on copy sheets comprising:

an image forming station for forming an unfused toner image on a copy sheet;

a drive for driving the copy sheet through the image forming station;

a fuser station located downstream of the imaging station for fusing the toner image on the copy sheet;

a second drive for driving the copy sheet through the fuser station, said second drive being linearly spaced from the second drive by a distance less than a length of the copy sheet in the direction of drive of a copy sheet;

a transport surface disposed between the first drive and the second drive for receiving a portion of a copy sheet extending from the first drive means toward the second drive means;

a determining means for determining separation between a copy sheet and the transport surface by tension imparted to the copy sheet; and means responsive to the determining means for controlling a relative speed differential between the first and second drive means, whereby the copy sheet is disposed toward the transport surface.

10. A copier as in claim 9, wherein the receiving surface includes a vacuum means for drawing the copy sheet toward the transport surface.

11. A copier as in claim 9, wherein the vacuum means includes a plenum and means for detecting pressure in the plenum.

12. A copier as in claim 9, wherein the second drive means includes means includes means for initializing the speed thereof to drive the copy sheets at a speed greater than the speed at which the first drive means drives the copy sheets.

13. A copier as in claim 9, wherein the controller means comprises means for controlling the speed of the second drive means.

14. A copier as in claim 9, wherein the transport surface is movable.

15. A copier as in claim 14, wherein the transport surface includes a vacuum means for drawing the copy sheet against the transport surface.

16. A copier as in claim 15, wherein the transport surface is a movable belt.

17. A copier as in claim 16, wherein a portion of the belt is offset from a linear path extending between the first drive means and the second drive means.

18. A copier as in claim 9, further comprising a deflector adjacent a downstream end of the sheet receiving surface for deflecting the copy sheet away from a linear path extending between the first drive means and the second drive means.

19. A copier for forming fusible images on a copy sheet comprising:

a movable photoreceptor for forming images of fusable toner;

means for moving a copy sheet as the fusable toner is transferred from the photoreceptor onto the copy sheet;

a fuser roll located downstream of the photoreceptor by a linear distance less than the length of a copy sheet in the direction of travel from the photoreceptor to the fuser roll;

a fuser roll drive for rotating the fuser roll;

a transport system disposed between the photoreceptor and the fuser roll for conveying a copy sheet from the photoreceptor to the fuser roll, the transport system including a movable surface for conveying the copy sheet and a vacuum means for drawing the copy sheet against the movable surface, the vacuum means including a vacuum plenum, the vacuum level in the plenum being related to the area of a copy sheet disposed against the movable surface;

a pressure sensor for sensing the vacuum in the plenum; and a controller for controlling the speed of the fuser roll drive in response to the vacuum sensed by the sensor.

20. A copier as in claim 19, wherein the controller slows the speed of the fuser roll in inverse relationship to the level of vacuum sensed by the sensor.

21. A copier as in claim 19, wherein the pressure sensor is a switch that activates and deactivates the fuser roll drive.

22. A method for controlling the transfer of a sheet between work stations comprising the steps of:

driving a sheet at a first speed at a first work station;

receiving a leading portion of the sheet on a receiving surface;

moving the leading edge of the sheet to a second work station while a trailing edge of the sheet is disposed in the first work station;

initially driving the leading edge of the sheet at the second work station at a second speed different from the first speed, whereby the sheet is separated by tension from the receiving surface;

sensing the separation of the sheet from the receiving surface; and adjusting the speed differential between the first speed and the second speed in response to sensing of said separation to reduce the separation between the sheet and the receiving surface.

23. A method as in claim 18, wherein the second speed is higher than the first speed.

24. A method as in claim 18, wherein the step of receiving the sheet on the receiving surface includes establishing a vacuum to draw the sheet against the receiving surface, and the step of sensing separation between the receiving surface and the sheet comprises sensing said vacuum.

25. A method as in claim 20, and further comprising the steps of transferring an unfused toner image onto the sheet at the first work station and fusing the toner image on the sheet at the second work station.

26. A method as in claim 22, further comprising the step of conveying a sheet on the receiving surface along a path offset from a linear path extending between the first and the second work stations.

27. A method as in claim 22, further comprising the step of deflecting a sheet away from a linear path extending between the first and the second work stations.

* * * * *